United States Patent [19]

Berniker

[11] 4,102,249

[45] Jul. 25, 1978

[54] PNEUMATICALLY DRIVEN DEVICES

[76] Inventor: Burton M. Berniker, 6524 Whitaker Ave., Van Nuys, Calif. 91406

[21] Appl. No.: 715,426

[22] Filed: Aug. 18, 1976

[51] Int. Cl.[2] ..... F01B 9/00; F15B 15/26

[52] U.S. Cl. ..... 91/186; 92/28; 92/76; 92/136

[58] Field of Search ..... 92/28, 182, 136, 76; 91/328, 186

[56] References Cited

U.S. PATENT DOCUMENTS

| | | | |
|---|---|---|---|
| 1,492,043 | 4/1924 | Mattson | 92/182 |
| 1,650,013 | 11/1927 | Gartin | 92/28 |
| 3,214,823 | 11/1965 | Hendrickson | 91/328 |
| 3,264,943 | 8/1966 | Schmitt | 92/28 |

FOREIGN PATENT DOCUMENTS

| | | | |
|---|---|---|---|
| 749,695 | 5/1956 | United Kingdom | 92/28 |

*Primary Examiner*—Paul E. Maslousky

*Attorney, Agent, or Firm*—Albert M. Herzig; Edward C. Walsh

[57] ABSTRACT

A pneumatically driven device which in the exemplary form of the invention is an air tool driven by pistons. In the exemplary form there are two pistons having racks which drive the reciprocatable shoe through pinion gears. One piston drives in each direction. Each piston at the end opposite the driven end has an annular groove in it with a sealing ring with ports for communicating air to the area behind the ring for pushing it out against the inside surface of the cylinder. During a piston stroke at this end of the piston air is compressed to provide a cushioning and braking effect which improves the overall operation, and avoids excessive wear.

10 Claims, 5 Drawing Figures

PNEUMATICALLY DRIVEN DEVICES

BACKGROUND OF THE INVENTION

1. Field of the Invention

The field of the invention is that of pneumatically driven devices and, more particularly, air tools driven by one or more air cylinders.

2. Description of the Prior Art

Many types of pneumatically driven devices including tools are known in the prior art. Some of these tools include sanding and filing devices wherein a shoe is reciprocated by way of one or more pistons. In number of known prior art devices which have been commercialized a piston carries a rack and a rack is mounted on a shoe, the piston driving a pinion gear which meshes with the rack on the shoe for driving it. In some constructions there are two pistons, each with a rack and each driving a separate pinion meshing with a rack on the shoe that is driven. Typical of known prior art devices of this type are those shown in U.S. Pat. Nos. 3,399,494; 3,214,823; 3,563,134; and 3,732,651. Typically, these devices are subject to the deficiency that when a piston is driving a reciprocating shoe, it, of course, develops momentum during its stroke and it must come to a full stop. The momentum of the piston has to be dissipated by way of its engagement with the teeth of the pinion gear which engages the rack on the shoe. This causes excessive wear on the teeth of the pinion and the teeth on the piston rack that necessitates early maintenance of the tool. It is even possible for the driven piston to be driven out through the end of its cylinder bore.

In the prior art it has been known to provide an effective sealing of a piston by way of a sealing ring fitting in an annular groove and with ports to communicate pressure to a position behind the ring to push it out for sealing. In the prior art this construction has appeared only at the end of the cylinder which acts against the driving pressure. This type of construction has been known in the patents, including U.S. Pat. Nos. 1,492,043; 2,332,763; 2,194,102.

The herein invention overcomes the deficiencies referred to in the foregoing in the manner described in detail hereinafter.

SUMMARY OF THE INVENTION

As indicated in the abstract in the exemplary form of the invention, it is embodied in an air tool of the type having a reciprocatable shoe which is driven by piston means, including two pistons. The pistons carry racks and the racks cooperate with pinion gears that in turn drive racks carried on the reciprocatable shoe.

The pistons operate in cylinder bores, one driving the shoe in one direction and the other driving the shoe in the opposite direction.

Each piston is provided with an annular groove adjacent each end of the piston. Fitted in each groove is a split sealing ring and ports are provided to communicate air pressure to the area behind the ring for pushing it outwardly.

The end of each piston that is opposite the driven end moves adjacent to the end wall of the piston bore. In the exemplary form of the invention as described, each piston, as it moves towards the end of the bore, causes compression of air and this air is communicated through the ports to the area behind the ring at that end. The ring at that end is pushed out so as to engage the interior of the bore with increased friction so that the ring tends to act as a brake serving to assist in dissipating the momentum of the piston. This serves to reduce or eliminate the excessive wear such as otherwise would occur by reason of the teeth engaging the pinion gears and being stopped by such engagement. Furthermore, the construction described permits the piston from being driven out through the end of the body.

In the light of the foregoing the primary object of the invention is to reduce the momentum of a moving piston in a bore so that this does not have to be accomplished by way of rack teeth carried by the piston engaging the teeth of a driven pinion gear.

A further object is to realize the foregoing by way of an annular groove and ring on the end of the piston opposite the driven end with ports for admitting fluid that is compressed into the area behind the piston to push it outwardly to realize a braking effect.

Further objects and additional advantages of the invention will become apparent from the following detailed description and annexed drawings.

DESCRIPTION OF THE PREFERRED EMBODIMENT

Figure 1:
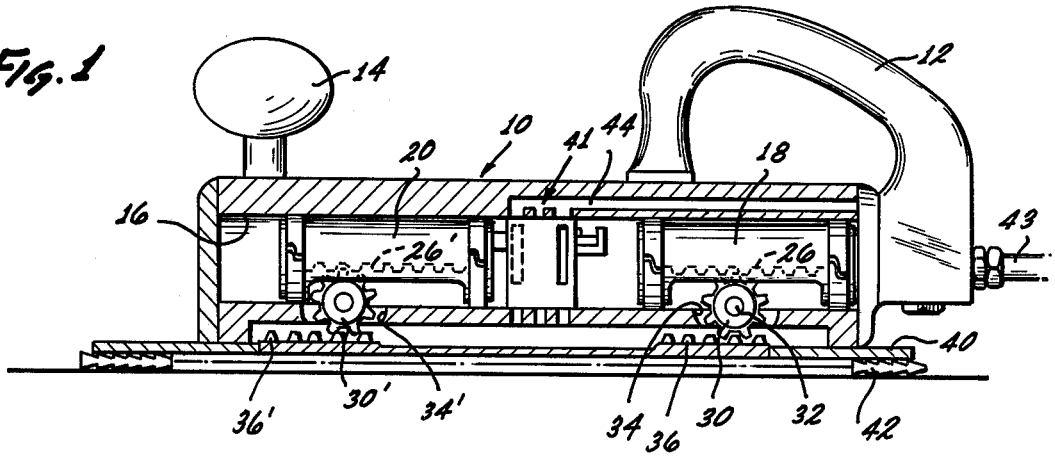
FIG. 1 is a sectional partly schematic view of an air driven sander tool of the type having two pistons and two pinion gears.

FIG. 1 of the drawings shows an exemplary form of sanding tool which may be of the type shown in U.S. Pat. No. 3,214,823 which is hereby incorporated herein by reference. Two driving pistons are shown. Each piston might also be of the type shown in U.S. Pat. No. 3,563,134 which is also incorporated herein by reference. As shown the tool has a body 10 with a rear grip 12 and a front handle provided by knob 14.

The body has a cylinder bore 16 within which are driving pistons as designated at 18 and 20 which are alike. Piston 18 is shown in detail in FIG. 2. The intermediate part of piston 18 is semicircular and it carries a driving rack 26. Meshing with the rack 26 is a driving pinion 30 mounted on a transverse shaft 32 mounted in the body 10. The pinion 30 extends through a slot 34 in the body 10. It drives a rack 36 carried on a reciprocating shoe 40 to which is attached a tool which may be a file 42.

The piston 20 is like the piston 18 having a similar rack 26' and a driving pinion 30' driving a shoe 36'.

The two pistons are driven outwardly intermittently by means of a valving mechanism designated generally by the numeral 41 which may be the same as that of the patents referred to. Numeral 43 designates an air admission line and numeral 44 designates a port forming an air line for communicating air to the valve mechanism 41 which controls admission of pressure to the driving ends of the two pistons. When the piston 18 is driven outwardly in the cylinder bore 16, it drives the shoe 40 in one direction. When the piston 20 is driven it drives the shoe 40 in the opposite direction through the pinion gear 30'. The valving mechanism 41 may be like that of U.S. Pat. No. 3,214,823 previously referred to.

Referring to FIGS. 2–5, it will be seen that the piston 18 has an annular groove 50 at the driven end in which is received a split ring 52 made of any suitable material, the ends being separated as indicated at 54. The ring 52 at the driving end provides appropriate sealing between the piston and the cylinder walls for the driving pressure that is admitted at that end.

Figure 2:
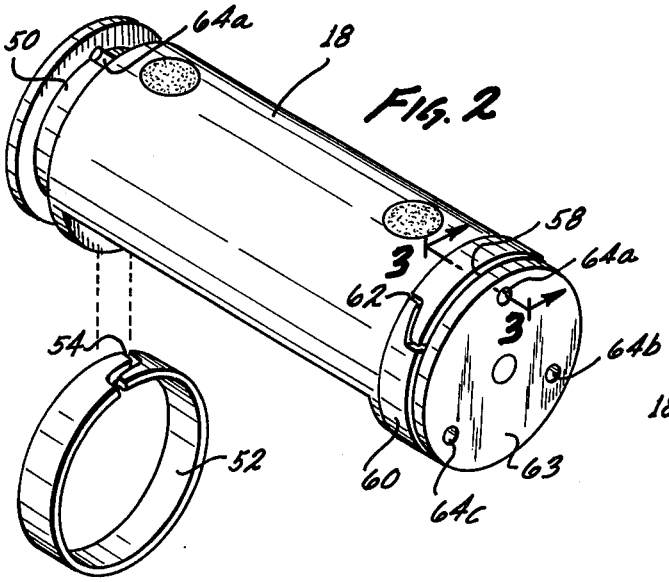
FIG. 2 is an isometric view of one of the pistons of the tool of FIG. 1.
Figure 3:
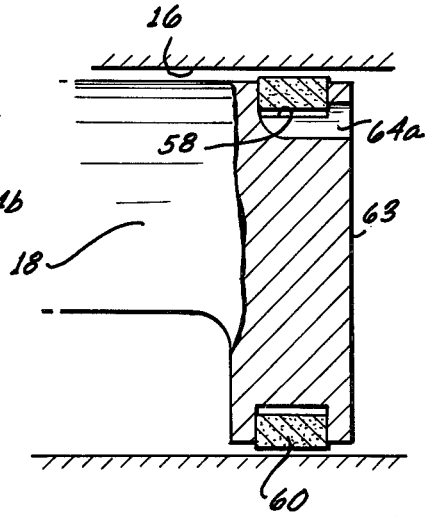
FIG. 3 is a cross-sectional view taken along the line 3—3 of FIG. 2.
Figure 4:
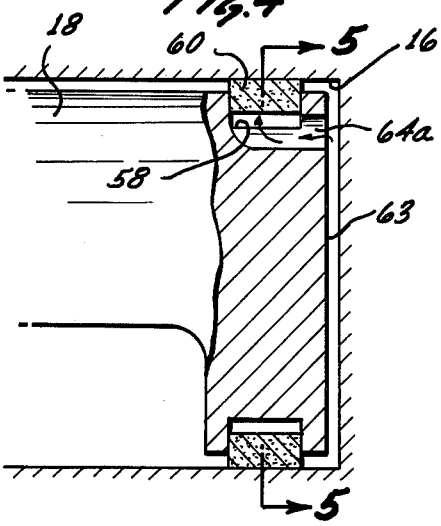
FIG. 4 is a sectional view of one end of one of the pistons.
Figure 5:
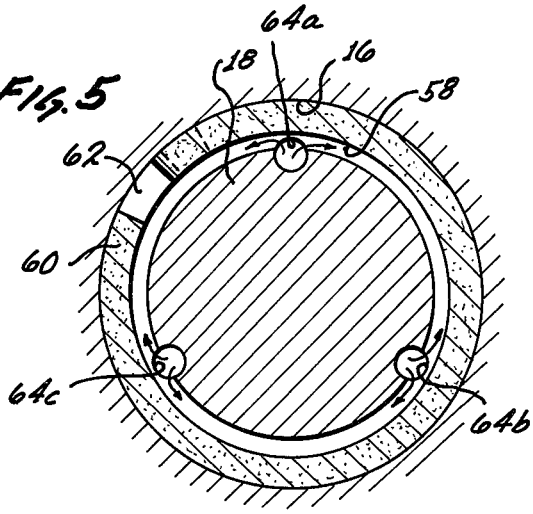
FIG. 5 is a cross-sectional view taken along line 5—5 of FIG. 4.

At the opposite end of piston 18 it has an annular groove which is designated at 58 in which there is split ring 60 having a separation as designated at 62 in FIG. 2. The end face of the piston 18 at the end opposite the driven end is designated by the numeral 63. In it are a plurality of axial ports 64*a*, 64*b*, and 64*c*. These axial ports communicate with the annular groove 58 as may be seen in FIGS. 4 and 5. The same type of ports are provided at the driven end of the piston, providing communication with the inside of the ring 52 for sealing purposes.

The operation of the invention is as follows. Referring to the piston 18, when it is being driven outwardly, that is to the right in FIG. 1, air is compressed between the end of the piston and the end of the cylinder bore. This pressure is communicated through the axial ports 64*a*, 64*b*, and 64*c* into the annular groove 58 behind the ring 60, causing it to be pushed out into engagement with the inside surfaces of the bore 16 as may be seen in FIGS. 4 and 5. The ring accordingly slides on the inside surface of the bore producing a braking effect. As the piston is driven outwardly it, of course, accumulates momentum. As previously explained, ordinarily this momentum would have to be dissipated by the engagement of the teeth of rack 26 with the pinion gear 30, causing excessive wear. With the ring 60, however, and with the pressure behind it, the ring acts as a brake having sufficient slowing down effect on the piston to avoid the drawback of the piston having to be stopped by engagement of the rack teeth with the pinion gear teeth. In this way the objects of the invention is realized. The possibility of the piston being driven through the end of the body is avoided.

The foregoing disclosure is representative of a preferred form of the invention and is to be interpreted in an illustrative rather than a limiting sense the invention to be accorded the full scope of the claims appended hereto.

What is claimed is:

1. In an apparatus having a body with a cylindrical bore in the body, a piston that is reciprocatable in the bore, means whereby pressure is caused to act on one end of the piston in one end of the bore for driving the piston away from that end of the bore, the construction being such that the piston pressurizes fluid at the other end of the bore, the other end of the piston being constructed to have a groove and having a sealing ring in the groove, with space in back of the ring, and the said other end of the piston being provided with passageway means whereby pressurized fluid at the other end of the piston is communicated to the space inwardly of the said sealing ring whereby to expand it outwardly against the walls of the bore whereby the said sealing ring serves to provide a braking effect on the movement of the piston towards the said other end of the bore.

2. A construction as in claim 1, wherein said sealing ring is a split ring, being rectangular in cross section.

3. Apparatus as in claim 1, embodying means whereby the said piston is caused to reciprocate in the bore.

4. Apparatus as in claim 3, wherein said last means comprises a mechanical means whereby the piston is reciprocated in one direction.

5. Apparatus as in claim 1, wherein said body has a second similar bore, a second similar piston in said second bore having a similar sealing ring and passageway means at the end opposite the driven end, and means interconnecting said pistons whereby they reciprocate in unison and the braking effects are produced by the expansion of the sealing rings at respective ends of the two pistons serving to prevent the pistons from striking the ends of the respective bores.

6. Apparatus as in claim 3, wherein the piston carries a gear rack, tool carrying means having a gear rack and a pinion gear positioned to mesh with the racks.

7. Apparatus as in claim 5, wherein each piston carries a gear rack, tool carrying means having two gear racks and a pair of pinion gears each positioned to mesh with a rack on a piston and a rack in the tool carrying means.

8. In an apparatus having a body with a cylindrical bore in the body, a piston that is reciprocatable in the bore, means for driving the piston away from one end of the bore, there being fluid in the other end of the bore, the construction being such that one end of the piston pressurizes fluid at the other end of the bore, the said one end of the piston being constructed to have a groove and having a sealing ring in the groove with space in the back of the ring and the said one end of the said piston being provided with passageway means whereby pressurized fluid at the one end of the piston is communicated to the space inwardly of the said sealing ring whereby to expand it outwardly against the walls of the bore whereby the said sealing ring serves to provide a braking effect on the movement of the piston towards the other end of the bore.

9. Apparatus as in claim 8, embodying means whereby the said piston is caused to reciprocate in the bore.

10. Apparatus as in claim 9 wherein said body has a second similar bore, a second similar piston in said second bore having a similar sealing ring and passageway means at one end and means interconnecting said pistons whereby they reciprocate in unison and the braking effects are produced by the expansion of the sealing rings at the respective ends of the two pistons serving to prevent the pistons from striking the ends of the respective bores.

* * * * *